US005338034A

United States Patent [19]

Asch

[11] Patent Number: 5,338,034

[45] Date of Patent: Aug. 16, 1994

[54] THREE-DIMENSIONAL PUZZLE

[76] Inventor: Sabine Asch, Heilbronner Strasse 100, 7120 Bietigheim-Bissingen, Fed. Rep. of Germany

[21] Appl. No.: 977,421

[22] Filed: Feb. 19, 1993

[30] Foreign Application Priority Data

Aug. 28, 1990 [DE] Fed. Rep. of Germany ... 9012334[U]

[51] Int. Cl.[5] ..... A63F 9/08

[52] U.S. Cl. ..... 273/155; 273/153 P

[58] Field of Search ..... 273/153 R, 155, 153 S, 273/153 P, 157 R, 157 A; 446/487

[56] References Cited

U.S. PATENT DOCUMENTS

| | | | |
|---|---|---|---|
| 2,992,829 | 7/1961 | Hopkins | 273/155 |
| 3,662,486 | 5/1972 | Freedman | 273/155 |
| 3,746,345 | 7/1973 | Palazzolo | 273/155 |
| 4,142,321 | 3/1979 | Coppa | 273/155 |
| 4,323,244 | 4/1982 | Busing | 273/155 |
| 5,108,100 | 4/1992 | Essebaggers et al. | 446/487 |

FOREIGN PATENT DOCUMENTS

| | | | |
|---|---|---|---|
| 2107200 | 4/1983 | United Kingdom | 273/155 |
| 2108395 | 5/1983 | United Kingdom | 273/155 |
| 2111395 | 7/1983 | United Kingdom | 273/155 |
| 9211911 | 7/1992 | World Int. Prop. O. | 273/155 |

OTHER PUBLICATIONS

International Preliminary Examination Report dated Jan. 26, 1993.

*Primary Examiner*—Vincent Millin
*Assistant Examiner*—Steven B. Wong
*Attorney, Agent, or Firm*—Evenson, McKeown, Edwards & Lenahan

[57] ABSTRACT

A three-dimensional puzzle which consists of several mutually permanently connected puzzle bodies which result in a regular tetrahedron in the assembled condition. In this case, all puzzle bodies are parts of irregular pyramids whose apexes, in the assembled condition, all meet at one point in the interior of the tetrahedron and whose bases form the tetrahedron surfaces in the assembled condition. All puzzle elements are also combined to a chain, specifically such that all puzzle elements, with the exception of the first and the last element, are in each case connected with the adjacent puzzle elements while they can be folded along an edge of the pyramid base.

6 Claims, 3 Drawing Sheets

THREE-DIMENSIONAL PUZZLE

BACKGROUND AND SUMMARY OF THE INVENTION

The invention is a three-dimensional puzzle game for adults and children which results in a regular tetrahedron in the assembled state. It is used for entertainment and for demonstrating a specific geometrical principle.

The main game value of known puzzles is the achieving of the more or less tricky task of creating an order out of disorder. The disassembling or mixing-up does not have any special appeal. This has the disadvantage that the interest in the puzzle will wane as soon as it is determined how it can be assembled correctly and be solved.

The tetrahedron puzzles known from U.S. Patent Documents U.S. Pat. No. 3,565,442 and U.S. Pat. No. 4,323,245 as well as the tetrahedron puzzle known from German Design Patent G 88 08 167.2 also have this disadvantage. In the case of the latter, this disadvantage is compensated by the fact that it can also be used for various purposes that are not game-related.

Another disadvantage of the known puzzles is that, even when they have a regular design, little attention is paid to the geometrical principles on which the puzzles are based because the "pile of rubble" of the individual pieces stimulates thoughts on how the destroyed whole can be restored and not on according to which principle the individual pieces were shaped.

In addition, familiarity alone is a disadvantage in the case of puzzle games, and there is always a demand for new puzzles.

It is an object of the invention to provide a three-dimensional puzzle game which is surprising with respect to its unfamiliar pattern and causes particular interest. The puzzle should be entertaining not only when it is put together but also when it is taken apart. For this purpose, the special characteristic of a tetrahedron, which is that, its four surfaces, when they are unfolded, form a straight band, should be illustrated in an impressive manner.

The puzzle game comprises several differently shaped elements which are all permanently connected with one another to form a chain. The element chain can be put together to form a filled-in regular tetrahedron. All elements are irregular pyramids. The number of elements is a multiple of four.

Other objects, advantages and novel features of the present invention will become apparent from the following detailed description of the invention when considered in conjunction with the accompanying drawings.

DETAILED DESCRIPTION OF THE DRAWINGS

Figure 1:
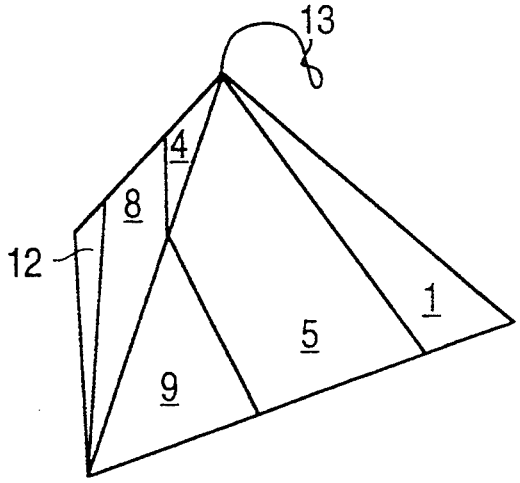
FIG. 1 is a view of an assembled puzzle.

FIG. 1 illustrates an embodiment of an assembled puzzle which consists of twelve elements. It is a regular tetrahedron of which two surfaces respectively are visible in the drawing. In this embodiment with twelve puzzle elements, three puzzle elements are visible on each tetrahedron surface; in the drawing these are the elements 1, 5, 9 and 4, 8, 12.

Figure 2:
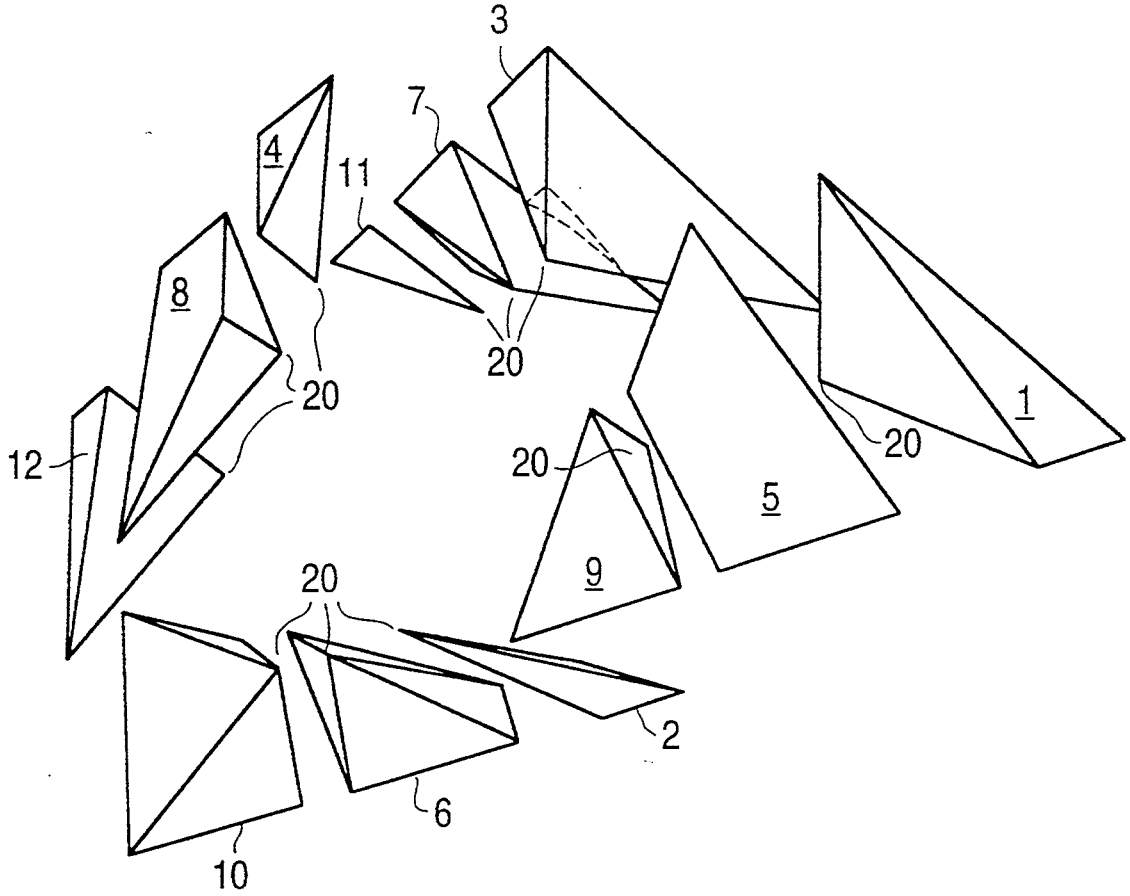
FIG. 2 is an exploded view of the individual elements the puzzle.

The individual elements 1 to 12 which make up the puzzle are illustrated in the exploded view of FIG. 2.

The pyramidal shape of the elements is determined as follows:

All bases of the pyramids are parts of one tetrahedron surface respectively. At least two sides of each base are situated on two different sides of a tetrahedron surface. All bases together result in the four complete tetrahedron surfaces. Along each side of the pyramid bases, precisely two bases adjoin one another which has the result that all respective adjacent sides have the same length. The sectioning of the tetrahedron surfaces must permit a placing-together of all segments along the edges which are situated on the tetrahedron edges.

Figure 4:
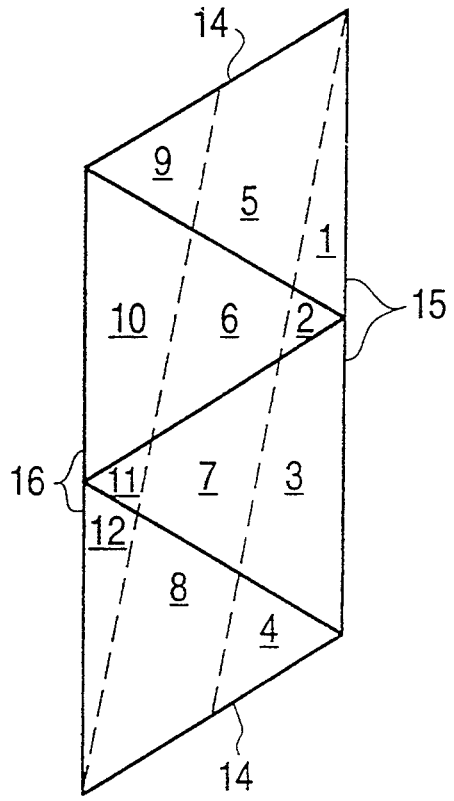
FIG. 4 is a view of the principle according to which the bases of the individual pyramidal elements are determined.

FIG. 4 illustrates the mentioned rules. Four tetrahedron surfaces are shown next to one another. On a tetrahedron body, the four equilateral triangles adjoin one another, as illustrated; in addition, the triangle sides which have the reference numbers 14, 15 and 16, each jointly form a tetrahedron edge. By means of the interrupted lines, these tetrahedron surfaces are sectioned into twelve incremental areas 1 to 12. All incremental areas can be placed next to one another in the sequence of their numbering along the sides which are situated on the tetrahedron edges. In this example, the number of twelve elements is achieved by a trisecting of each tetrahedron surface. Correspondingly, only eight elements may be created by bisecting the tetrahedron surfaces, or 16 elements may be created by dividing the tetrahedron surfaces into four parts, etc.

The remaining surfaces and thus the shape of the pyramidal puzzle elements is determined by the fact that, in the assembled puzzle, all pyramid apexes 20 meet in a point in the interior of the tetrahedron. This also results in the fact that two elements respectively have an identical surface which is their contact surface in the interior of the assembled tetrahedron. As in the illustrated embodiment, the meeting point of all elements may be the center of the tetrahedron but also any other point in the interior of the tetrahedron. As indicated by means of the element 3 by an interrupted line in FIG. 2, it is also possible to cut off, at least in the case of some of the pyramidal puzzle elements, the interior apex 20 so that a hollow space remains in the interior of the tetrahedron which may be utilized for the accommodating of parts which, are arranged, as it were, in a "packaged" manner in the tetrahedron after its assembly. A small bottle of perfume or a piece of jewelry may, for example, be accommodated in the interior.

Figure 3A:
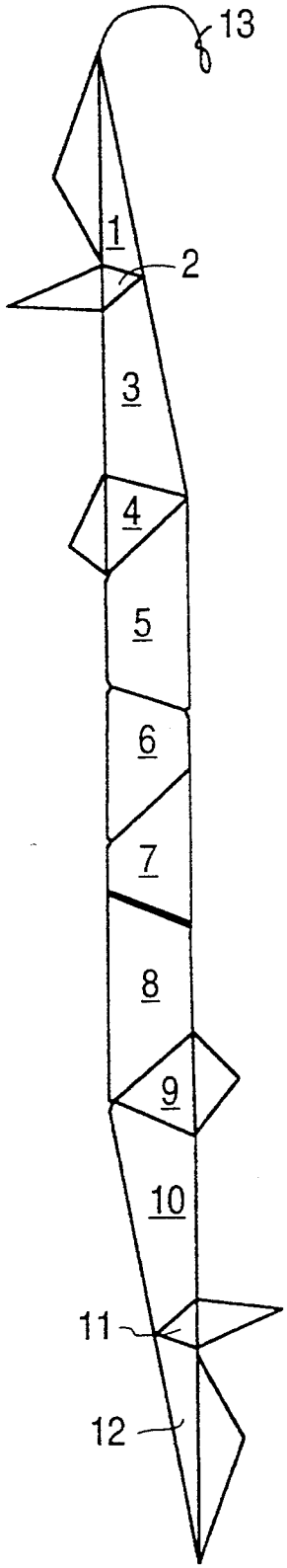
FIGS. 3*a* and 3*b* are front and rear views of the disassembled element chain.
Figure 3B:
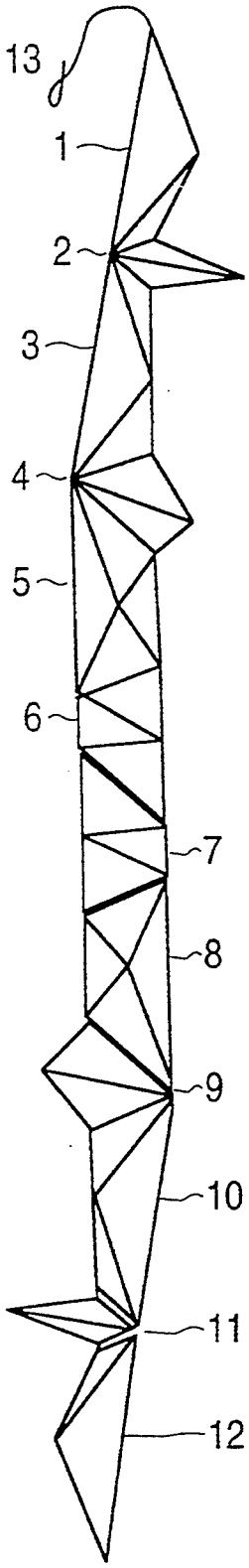

All elements are, in each case, permanently connected with one another along an edge, specifically such that the assembled tetrahedron can be opened up into an element chain, as illustrated in FIG. 3*a* from the front and in FIG. 3*b* from the rear. From the front, all element surfaces 1 to 12 are visible which, when the tetrahedron is assembled, are situated on the outside and form its surfaces; from the rear, only those element surfaces are visible which are situated on the inside when the tetrahedron is assembled. The unmarked surfaces which are visible in the front view of FIG. 3*a*, when the puzzle is assembled, are also situated on the inside.

Two edges of the bases of the pyramidal elements, thus of the areas which are on the outside when the tetrahedron is assembled, are in each case connected with one another. Those edges are always connected which together form a portion of the tetrahedron edge. FIGS. 3*a*, 3*b* and FIG. 4 show the sequence of the elements in the chain: the parts with the bases 1 to 12 are placed next to one another in the sequence of their numbering.

Figure 5:
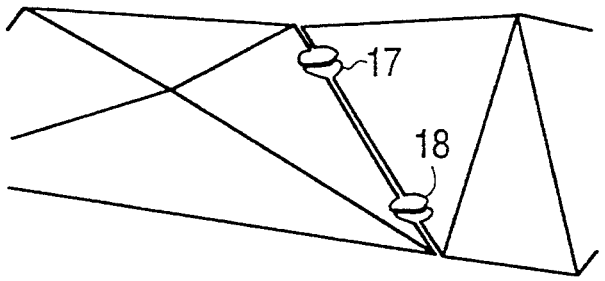
FIG. 5 is a view of the connection of the elements in the example of two connected elements.

The respective two connected edges have the same length. They directly abut with one another along their whole length. The connection is flexible so that the parts can be folded about the axis of the connected edges with respect to one another. The connection may be established by means of hinges, bands, threads, or similar devices. FIG. 5 shows the connection of two puzzle pieces as an example. The edges of both pieces are connected with one another at two points by means of threads 17 and 18. The threads are fastened on the inside of the puzzle body or pulled through to the next connecting point.

A further development provides a holding device which is mounted on the first element in the puzzle chain. In FIG. 1 and FIGS. 3*a* and 3*b*, it is represented as a thread with a loop 13. This holding device facilitates the manipulating of the game. It may, for example, be a chain, a band, a ring or a thread and may also be constructed as a decorative element.

The puzzle game may be manufactured from firm materials, such as metal, plastic, plexiglass, wood or cardboard. The puzzle bodies may be solid or hollow. The visual effect of the game can be heightened by different materials, a coloring or a surface treatment of the individual elements or of their individual surfaces.

The principle on which the puzzle game is based is established well in the case of eight elements. The effect of the puzzle becomes the more enticing and the more attractive aesthetically, the larger the number of elements.

It is the special attraction of this game that the unexpected transformation of the tetrahedron into a long chain which has the effect of a straight band is surprising. The joy in this transformation is long lasting so that the puzzle continues to be enticing. The correct assembling method is usually not recognized immediately because the long chain seems to have nothing in common with the solid tetrahedron. Once the solution has been found, the puzzle can be assembled again rapidly and easily so that one does not hesitate to disassemble it again.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A three-dimensional puzzle comprising:

a plurality of puzzle bodies which form a regular tetrahedron when in a predetermined assembled condition, each of said puzzle elements being shaped as irregular pyramids whose apexes meet at one point in an interior part of the tetrahedron when in the assembled condition and whose bases form surfaces of the tetrahedron when in the assembled condition, and permanent connection devices for connecting the puzzle elements with one another to form a chain of puzzle elements, said permanent connection devices serving to connect respective edges of associated pyramid bases with said edges abutting directly while accommodating folding of said elements with respect to one another about an axis along connected edges thereof.

2. A three-dimensional puzzle according to claim 1, wherein said puzzle elements are configured so that, in the assembled condition, all surfaces of the puzzle elements other than their bases are disposed in the interior of the tetrahedron.

3. A three-dimensional puzzle according to claim 2, wherein the puzzle elements are configured such that bases of the irregular pyramids constituting the puzzle elements from a planar band which tapers towards opposite ends of the band when the puzzle elements are in a chain-like unassembled condition.

4. A three-dimensional puzzle according to claim 3, comprising:

a manually engageable holding device connected to one of the puzzle elements which is at an end of the chain when in the unassembled condition.

5. A three-dimensional puzzle according to claim 4, wherein said holding device is one of a chain, a thread, and a ring.

6. A three-dimensional puzzle according to claim 1, comprising:

a truncated pyramid puzzle element connected to other of said puzzle elements and serving to form a hollow space in the assembled condition of the puzzle elements.

* * * * *